US007461761B2

(12) United States Patent
Hildreth

(10) Patent No.: US 7,461,761 B2
(45) Date of Patent: Dec. 9, 2008

(54) HARNESS FOR SUSPENDING DETERGENT CONTAINER

(75) Inventor: Bradley Hildreth, Garden City, NY (US)

(73) Assignee: Hallmont, LLC, Garden City, NY (US)

( * ) Notice: Subject to any disclaimer, the term of this patent is extended or adjusted under 35 U.S.C. 154(b) by 521 days.

(21) Appl. No.: 11/040,699

(22) Filed: Jan. 25, 2005

(65) Prior Publication Data

US 2005/0161473 A1 Jul. 28, 2005

Related U.S. Application Data

(60) Provisional application No. 60/539,123, filed on Jan. 26, 2004.

(51) Int. Cl.
*B67D 5/06* (2006.01)

(52) U.S. Cl. ..... 222/181.2; 222/181.1; 222/181.3; 222/173; 222/482; 224/148.2; 224/148.4; 224/148.7

(58) Field of Classification Search ..... 222/181.1, 222/183, 181.2, 173, 181.3, 174, 185.1, 481, 222/465.1, 482, 485.1, 478, 148.2, 148.6, 222/148.7, 148.4; 224/148.1
See application file for complete search history.

(56) References Cited

U.S. PATENT DOCUMENTS 222,831 A * 12/1879 Marsh ..... 239/154
2,013,358 A * 9/1935 Osborne ..... 224/148.2
2,684,787 A * 7/1954 Charpiat ..... 222/175
4,095,589 A 6/1978 Manschot et al.
4,189,789 A 2/1980 Hofstetter
4,240,480 A 12/1980 Strobel
4,468,810 A 8/1984 Longo
4,537,377 A 8/1985 Shewchuk
4,612,965 A 9/1986 McGregor
4,632,350 A 12/1986 Brown
4,792,239 A 12/1988 Hamada et al.
4,812,054 A * 3/1989 Kirkendall ..... 383/110
4,848,660 A * 7/1989 O'Connell ..... 239/154
4,869,398 A 9/1989 Colvin et al.
4,869,402 A * 9/1989 Ash, Jr. ..... 222/209
4,901,959 A 2/1990 Stage
4,998,647 A 3/1991 Sharp
5,044,522 A 9/1991 Roig et al.
5,232,664 A 8/1993 Krawzak et al.
5,330,049 A 7/1994 Bertelsen et al.
5,344,109 A 9/1994 Hokoana, Jr.
5,449,348 A 9/1995 Dryden
5,642,762 A 7/1997 Greenberg et al.
5,954,238 A * 9/1999 Rausch ..... 222/158
6,029,810 A 2/2000 Chen
6,123,240 A 9/2000 Fowles et al.
6,155,526 A 12/2000 Brown
6,209,734 B1 4/2001 Wang
6,367,757 B1 4/2002 Aramaki (Continued)

*Primary Examiner*—Frederick C. Nicolas
(74) *Attorney, Agent, or Firm*—Hoffmann & Baron, LLP

(57) ABSTRACT

A harness for suspending a container having a product dispensing valve, such as a laundry detergent container, generally includes a sling for holding the container therein in an orientation that permits dispensing of a product from the container and at least one strap attached to the sling for suspending the sling from above. The sling further has a valve opening for allowing the product dispensing valve of the container to protrude out of the sling.

12 Claims, 5 Drawing Sheets

U.S. PATENT DOCUMENTS 6,443,329 B1 9/2002 Rochefort et al.
6,464,086 B1 10/2002 Klein et al.
6,464,087 B1 10/2002 Klein et al.
6,494,344 B1 12/2002 Kressel, Sr.
6,533,457 B1 3/2003 Schwenke et al.
6,588,626 B2 7/2003 Sauer et al.
6,651,947 B1 11/2003 Price
6,659,669 B1 12/2003 Nguyen

* cited by examiner

HARNESS FOR SUSPENDING DETERGENT CONTAINER

CROSS-REFERENCE TO RELATED APPLICATIONS

This application claims the benefit of U.S. Provisional Application No. 60/539,123, filed on Jan. 26, 2004.

BACKGROUND OF THE INVENTION

The present invention relates generally to a device for suspending a large volume liquid detergent container above or adjacent to a washing machine for conveniently dispensing detergent from the container.

Buying in bulk, especially bulk purchases of non-perishable items such as laundry detergent, has become very popular in recent years. Laundry detergent in particular is readily available in large containers. One of the more popular bulk sizes of laundry detergent is the 300-ounce laundry detergent container that is available in many stores today. This container has a built-in valve to moderate the flow of detergent to a washing machine and a built-in cap that is used as a vent to provide air into the container for allowing maximum flow from the dispensing valve.

Needless to say, a detergent container of this large size is extremely bulky and difficult to handle, particularly when attempting to maneuver the container into position over the opening of the washing machine to dispense detergent therein. In a typical household laundry area, a large detergent container would likely be kept on the top of a dryer, adjacent to the washing machine, to minimize lifting or moving of the container. However, this eliminates space on top of the dryer which may otherwise be used for folding clothes. Additionally, a large container kept on top of the dryer may block critical access to the dryer lint filter.

Accordingly, it would be desirable to provide a means for storing a large, heavy, laundry detergent container near a washing machine in a manner in which the container is easily accessible and maneuverable, yet does not take up needed space in the laundry area. It is known in the art to provide hanging supports and hanging bags for storage and organization of such items as shoes, clothes, and other bulky items. However, it has been heretofore unknown to provide a hanging device for such household items as large detergent containers. Additionally, it would be desirable to provide such a device that further permits easy viewing of the liquid level within the container and has provisions for the container dispenser valve and vent cap.

SUMMARY OF THE INVENTION

The present invention involves a harness for suspending a container having a product dispensing valve. The harness generally includes a sling for holding the container therein in an orientation that permits dispensing of a product from the container and at least one strap attached to the sling for suspending the sling from above. The sling further has a valve opening for allowing the product dispensing valve of the container to protrude out of the sling.

In a preferred embodiment, the sling is in the form of a sling body having a bottom and a front wall extending upwardly from the bottom, wherein the front wall has the valve opening formed therein. The front wall of the sling body further preferably includes a handle opening for allowing a handle of the container to protrude out of the sling body and has a height sufficient to permit access to a vent cap of the container.

Preferably, the sling body further includes a back wall and two side walls extending upwardly from the bottom, wherein the bottom, the front wall, the back wall and the side walls form a bag for supporting the container therein. The back wall preferably includes at least one air hole formed therethrough and may further include a spacer block removably attached thereto for spacing the sling body away from a wall.

In an alternative embodiment, the sling is a lattice of bands forming a structure for supporting the container therein. The band lattice includes at least two vertical bands for supporting the weight of the container and at least one horizontal band for stabilizing the sides of the container and engaging with a handle of the container.

In either embodiment, the harness preferably includes two front strap portions and two rear strap portions each respectively attached at one end to the sling body. The front strap portions are disposed at an angle with respect to the rear strap portions to facilitate suspending the sling body from a wall. Moreover, the strap portions are connected together with a hook opposite the sling body attachment ends.

The present invention further involves a method for suspending a laundry detergent container having a detergent dispensing valve over a washing machine. The method of the present invention generally includes the steps of positioning the container within a harness, wherein the detergent dispensing valve protrudes outwardly from a valve opening of the harness, and hanging the harness from a structure above the washing machine in an orientation that permits dispensing of detergent from the detergent dispensing valve.

As a result of the present invention, a means is provided for suspending a heavy liquid-dispensing container while simultaneously holding the container against a wall. The device of the present invention further provides a means to see the fluid level within the container and makes provisions for inlet of air to the container and outlet of fluid from the container.

These and other objects, features, and advantages of this invention will become apparent from the following detailed description of illustrative embodiments thereof, which is to be read in connection with the accompanying drawings.

DETAILED DESCRIPTION OF THE PREFERRED EMBODIMENTS

Figure 1:
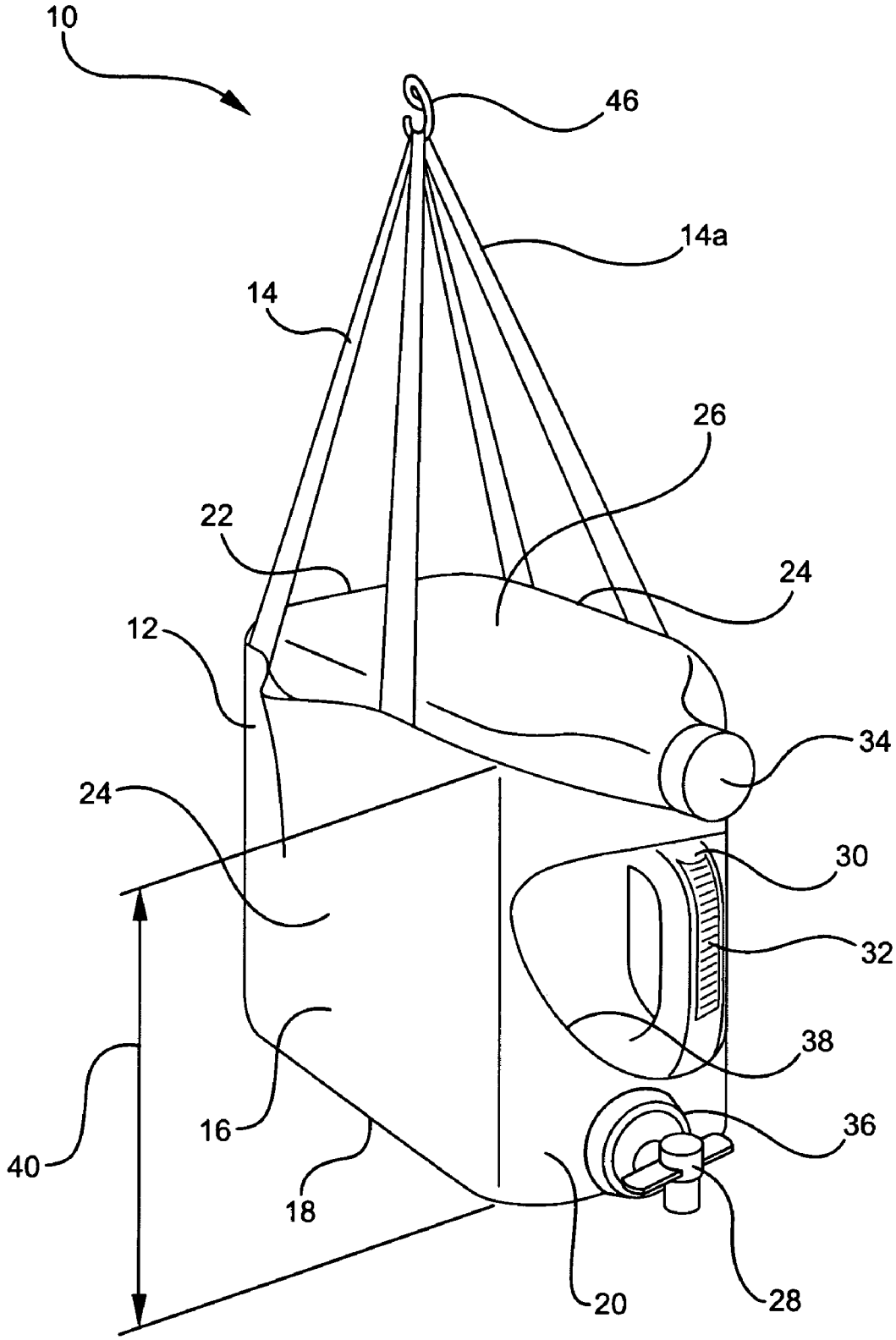
FIG. 1 is a top perspective view of a harness for suspending a detergent container, formed in accordance with the present invention, shown together with a container supported therein.

FIGS. 1-4 show a preferred embodiment of a harness 10 for suspending a container having a product dispensing valve, formed in accordance with the present invention. The harness 10 generally includes a sling 12 and at least one strap 14 for suspending the sling from above.

In the preferred embodiment, the sling 12 is in the form of a bag-like body 16 having a bottom 18 and four walls, including a front wall 20, a back wall 22 and two side walls 24 extending upwardly from the bottom. As will be described in further detail below, the sling 12 is designed to hold a large container therein in an orientation that permits easy dispensing of a product from the container.

Figure 3:
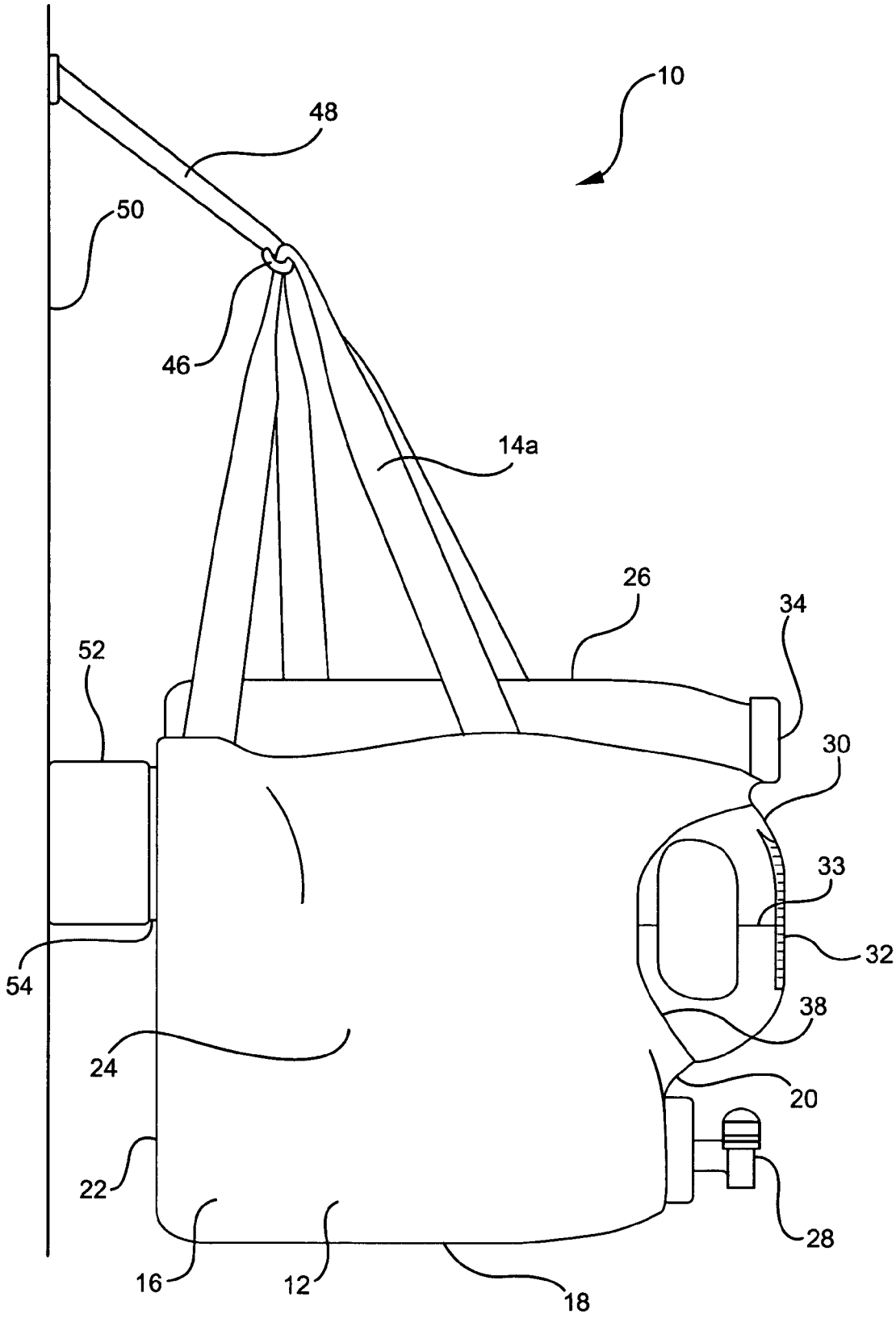
FIG. 3 is a side plan view of the harness and container shown in FIG. 1.

Also in the preferred embodiment, the harness 10 includes four straps 14 attached to the sling 12 at or adjacent to the corners formed by the side walls 24. The straps 14 may be stitched or otherwise attached to the sling body 16 in a conventional manner and may include four individual straps or two strap lengths connected at their respective ends to form four strap arms. The straps 14 are attached to the sling body 16 in a manner that permits the harness to be suspended from either a wall or a ceiling. In particular, the front straps 14*a*, seen on the right in FIG. 3, are angled somewhat where they connect with the sling body 16, to make provision for the fact that the harness 10 may hang against a wall structure behind the back wall 22 of the sling body 16.

The container 26, for which the harness 10 is optimally designed, is a large-sized container, particularly for liquid laundry detergent, and generally includes a built-in valve 28 for dispensing the liquid from the container, a handle 30, which may include a fluid level indicator 32 incorporated therein, and a vent cap 34, which operates to allow air into the container to facilitate liquid dispensing. The handle 30 is typically positioned between the valve 28 and the cap 34 at the top of the container, with the valve oriented so as to permit dispensing of liquid when the container is tipped on its side. 300-ounce liquid detergent containers of this type are readily available in most bulk-discount stores that are popular today.

Figure 4:
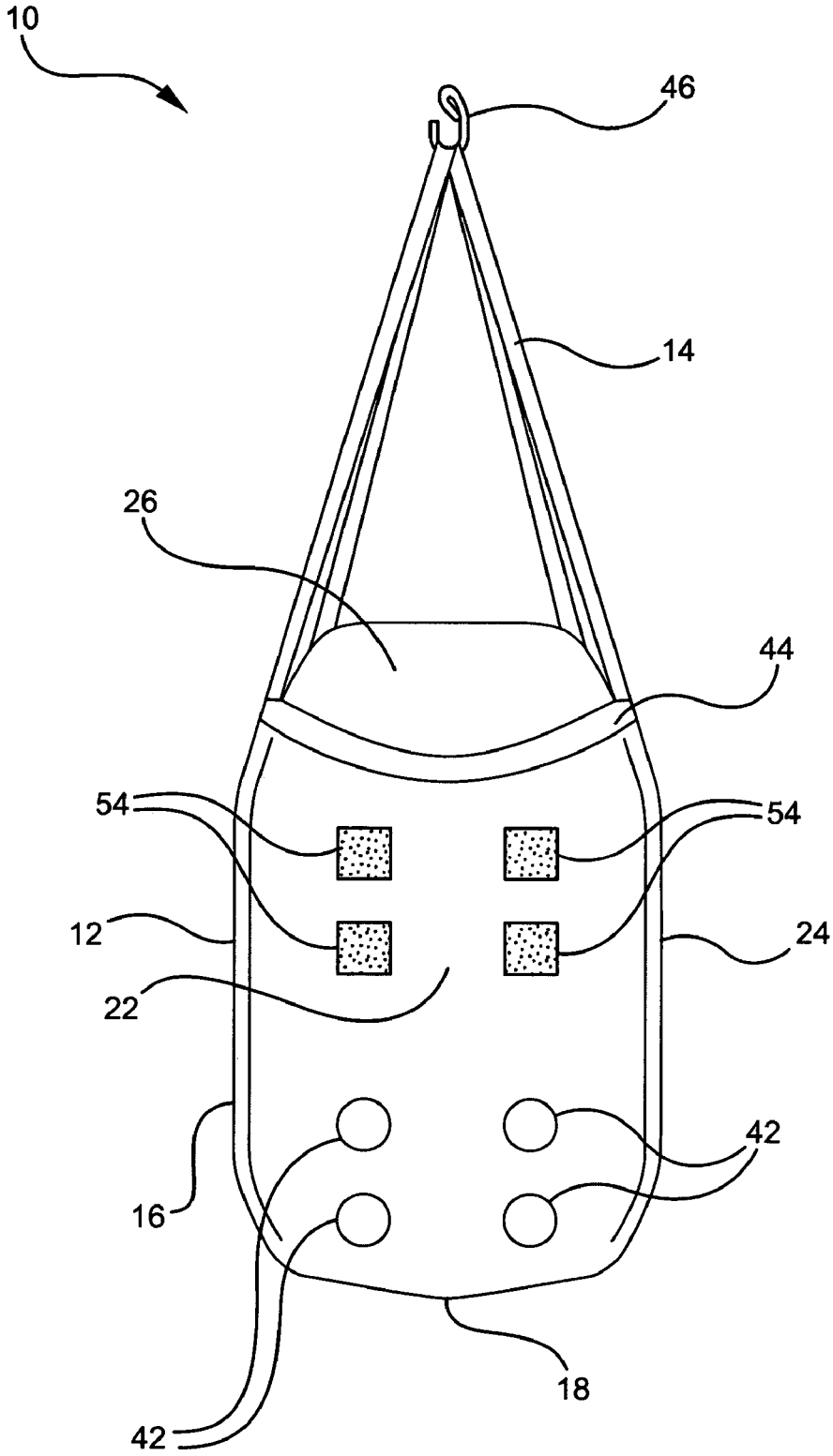
FIG. 4 is a back plan view of the harness and container shown in FIG. 1.

As mentioned above, the sling 12 is designed to hold the container 26 on its side to permit dispensing of the liquid from the container valve 28. In this regard, the container 26 is positioned within the sling 12 so that the sling bottom 18 supports the side of the container nearest the valve 28 and the front wall 20 of the sling supports the top of the container. To permit the valve 28 to protrude out of the sling 12, the front wall 20 of the sling body 16 includes a valve opening 36 near the bottom 18 of the sling. The front wall 20 further preferably includes a handle opening 38 which permits the container handle 30 to extend out of the sling 12. Additionally, the front wall 20 further preferably has a height 40 that is less than the distance between the container cap 34 and the container side wall that is nearest the valve 28. In this manner, the container cap 34 will not be confined within the sling when the container 26 is supported therein, so that the cap will be accessible for venting the container as required. Also, for safety purposes, the back wall 22 of the sling body 16 preferably includes one or more air holes 42, as shown in FIG. 4, to prevent suffocation should a child place the bag over his or her head when not in use.

Figure 2:
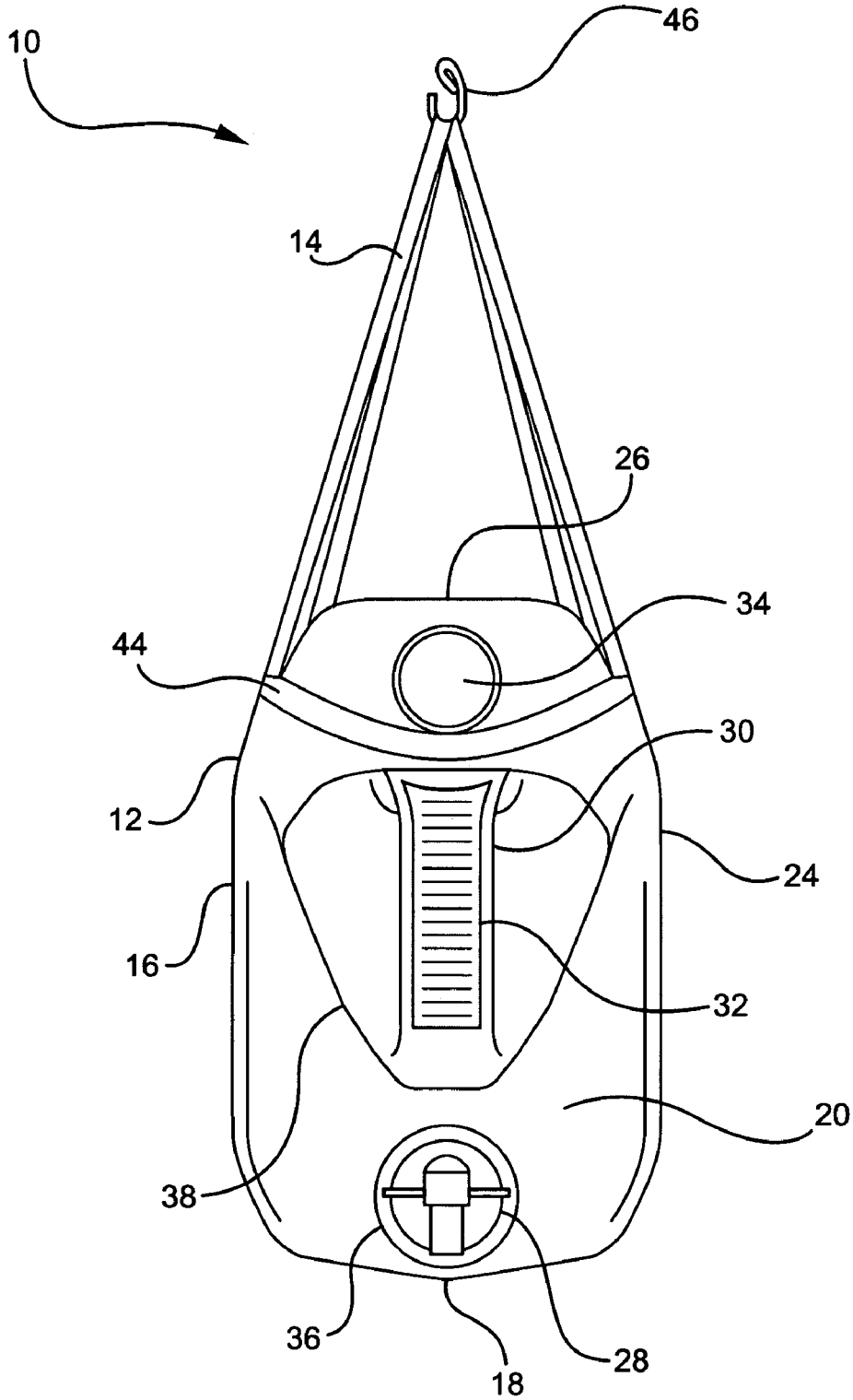
FIG. 2 is a front plan view of the harness and container shown in FIG. 1.

Thus, the valve opening 36 allows the container valve 28 to protrude out of the sling 12 while the container 26 is supported therein for dispensing liquid from the container. The handle opening 38 permits access to the container handle 30 to grasp the container if required and also allows for easy viewing of the fluid level indicator 32 from the front, as shown in FIG. 2, or the side, as shown in FIG. 3. (The fluid level is depicted in FIG. 3 as half full, which is seen by looking at the line 33 in the container handle 30.) Furthermore, the front wall 20 is additionally designed to make available the vent cap 34.

The sling body 16 can be made from any strong and durable fabric or polymeric material. Such materials include nylon, cotton materials and burlap. The sling body 16 may be made from a single sheet of material stitched together to form the bag-like structure described above. To improve the strength of the sling body 16, the upper edge or rim 44 of one or more of the front wall 20, the back wall 22 and the side walls 24 may be folded over and sewn to itself, as shown in FIGS. 2 and 4. This will provide a reinforced area of high tension immediately below the vent cap 34, as shown in FIG. 2, to accommodate the increased load on the upper front portion of the sling, and will also provide reinforced areas for attachment of the straps 14 and to counter the horizontal component of the tension on the front straps 14*a*.

In use, the detergent container 26 is placed in the harness 10 by sliding it between the straps 14 into the large opening of the sling body 16 defined by the front wall 20, back wall 22 and side walls 24. The container is positioned in the sling body 16 so that the top of the container faces the front wall 20 of the sling body 16 and the container valve 28 is directed through the front wall valve opening 36. Once the container 26 is in place, the straps 14 are then used to hang the sling from above. To facilitate hanging, the straps 14 may be joined together at a hook 46, which may be used to suspend the harness from a ceiling or wall structure. The hook 46 may further be connected to an adapter strap 48, as shown in FIG. 3, to adjust the distance between the harness 10 and a wall structure 50, if required. In this regard, the harness 10 may be provided with one or more differently sized spacer blocks 52 which can be removably attached to the back wall 22 of the sling body 16 with, for example, Velcro™ strips 54 attached on an upper portion of the back wall.

Figure 5:
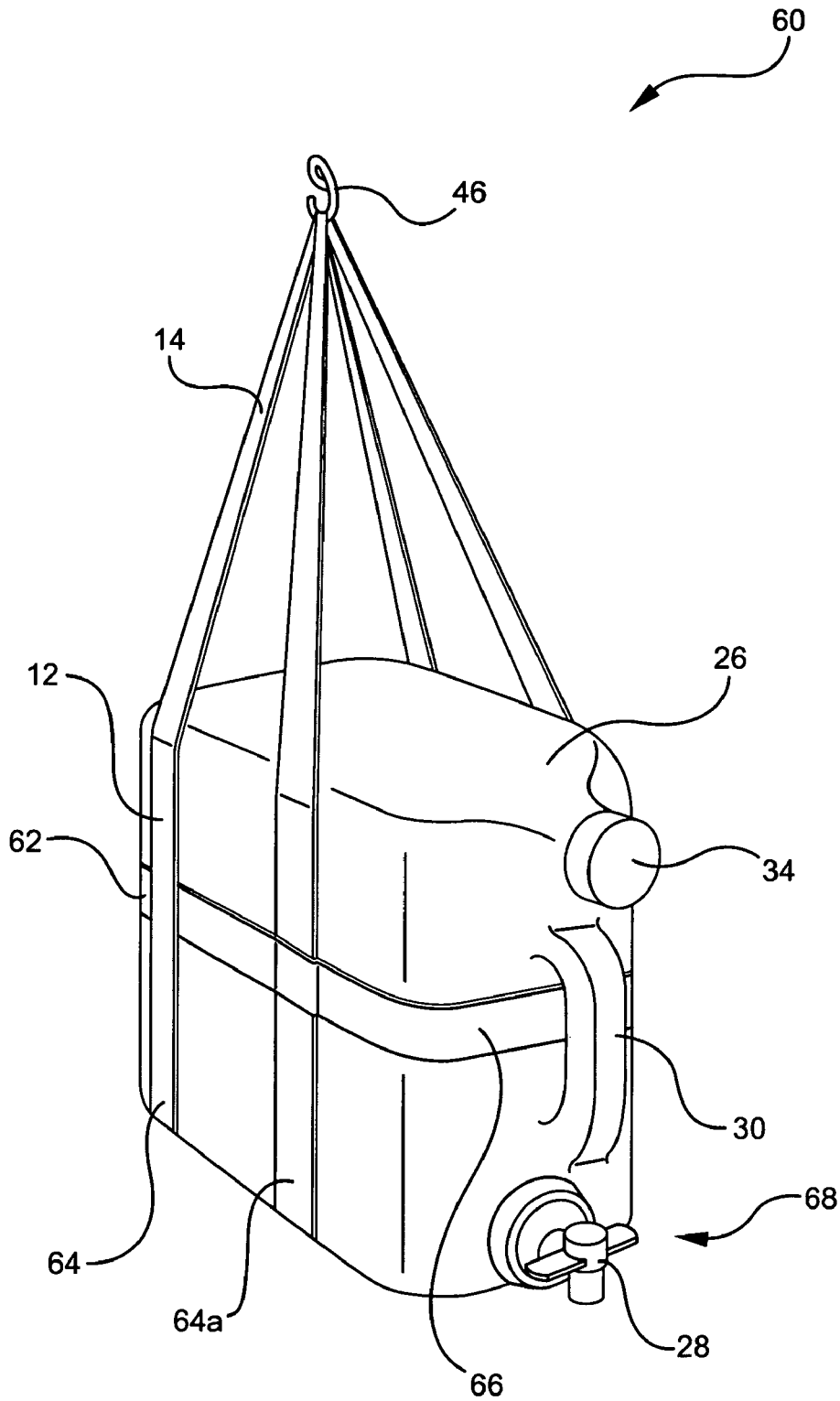
FIG. 5 is a top perspective view of an alternative embodiment of a harness for suspending a detergent container formed in accordance with the present invention.

FIG. 5 shows an alternative embodiment of a harness 60 according to the present invention. In this embodiment, the sling body 16 of the sling 12 is replaced by a band lattice 62 forming a structure to support the container 26 therein. The band lattice 62 may be made integral with the suspending straps 14 or may be otherwise connected therewith in a conventional manner. The band lattice 62 generally includes at least two vertical bands 64 wrapping around and supporting the weight of the container from underneath and at least one horizontal band 66 for stabilizing the sides of the container. The horizontal band 66 is attached to the vertical bands 64 at a location that will position the horizontal band roughly in the center of the container 26 when the container is placed in the sling 12. The horizontal band 66 is also preferably removably attached to at least one of the forward vertical bands 64*a* so that the horizontal band can be detached from the vertical band, threaded through the container handle 30 and then reattached to the vertical band upon placement of the container 26 in the sling 12. The band lattice 62 as thus described also defines an opening 68 for the container valve 28 and allows for easy viewing and access to both the handle 30 and the vent cap 34.

In either embodiment, the harness 10, 60 may be held against the wall behind a washing machine. When the washing machine is also against the wall, this places the container valve 28 at the correct position for detergent to flow into the washing machine without spilling onto the outside of the washing machine. Upon testing the invention, it has been found that a person could easily put a detergent container into the sling, and that the sling could then be lifted onto a hook suspended from the wall over a washing machine, and that detergent could be repeatedly and easily poured into the washing machine by means of the container's valve.

Thus, the harness 10, 60 of the present invention can be attached to a structure in the home to secure the detergent container 26 at the correct height above a washing machine to clear the opened lid of the washing machine, and at the correct position above the opening to the washing machine to allow easy dispensing of detergent into the washing machine. This removes the need to store the detergent on the dryer, or other shelf space, and removes the requirement to lift the container each time a load is washed. The present invention keeps the container steady against a wall by means of strap positions, the appropriate angling of the strap attachments, and reinforcement of the resulting high-tension areas of the invention.

Additionally, the harness of the present invention accommodates the features built into a typical large bulk detergent container 26. Specifically, the container valve 28 is provided a place to poke through the sling 12 for easy product dispensing. The container vent cap 34 is exposed for easy opening and the liquid level is easily visible by means of the handle opening that serves as a viewing window, all the while maintaining the structural integrity needed to support the weight of a 300-ounce liquid detergent container. Of course, the harness of the present invention is not limited to liquid detergent containers, but may also be utilized to facilitate dispensing of other types of products from their respective containers.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A harness for suspending a container having a product dispensing valve, the harness comprising:

a sling for holding the container therein in an orientation that permits dispensing of a product from the container, said sling having a valve opening for allowing the product dispensing valve of the container to protrude out of said sling; and at least one strap attached to said sling for suspending said sling from above, wherein said sling comprises a sling body having a bottom and a front wall extending upwardly from said bottom, said front wall having said valve opening formed therein, and wherein said front wall of said sling body further comprises a handle opening for allowing a handle of the container to protrude out of said sling body.

2. A harness as defined in claim 1, wherein said front wall of said sling body has a height sufficient to permit access to a vent cap of the container.

3. A harness as defined in claim 1, wherein said back wall includes at least one hole formed therethrough for providing air into said bag.

4. A harness as defined in claim 1, wherein said front wall has said valve opening formed therein.

5. A harness for suspending a container having a product dispensing valve, the harness comprising:

a sling for holding the container therein in an orientation that permits dispensing of a product from the container, said sling having a valve opening for allowing the product dispensing valve of the container to protrude out of said sling; and at least one strap attached to said sling for suspending said sling from above, wherein said sling comprises a sling body having a bottom, a front wall extending upwardly from said bottom, a back wall and two side walls extending upwardly from said bottom, said front wall, said back wall and said side walls forming a bag for supporting the container therein, and wherein the harness comprises two front strap portions and two rear strap portions each respectively attached at one end to said sling body, said front strap portions being disposed at an angle with respect to said rear strap portions to facilitate suspending said sling body from a wall.

6. A harness as defined in claim 5, wherein said strap portions are connected together with a hook opposite said sling body attachment ends.

7. A harness for suspending a container having a product dispensing valve, the harness comprising:

a sling for holding the container therein in an orientation that permits dispensing of a product from the container, said sling having a valve opening for allowing the product dispensing valve of the container to protrude out of said sling; and at least one strap attached to said sling for suspending said sling from above, wherein said sling comprises a sling body having a bottom, a front wall extending upwardly from said bottom, a back wall and two side walls extending upwardly from said bottom, said front wall, said back wall and said side walls forming a bag for supporting the container therein, and wherein said back wall includes a spacer block removably attached thereto for spacing said sling body away from a wall.

8. In combination:

a container having a product dispensing valve; and a harness for suspending said container in an orientation that permits dispensing of a product from said container, said harness comprising a sling for holding said container therein and at least one strap for suspending said sling from above, wherein said sling includes a valve opening for allowing said product dispensing valve of said container to protrude out of said sling, and wherein said sling comprises a sling body having a bottom and a front wall extending upwardly from said bottom, said front wall having said valve opening formed therein, and wherein said container further comprises a handle and said sling body further comprises a handle opening for allowing said handle of said container to protrude out of said sling body.

9. A combination as defined in claim 8, wherein said container further comprises a vent cap and said front wall of said sling body has a height sufficient to permit access to said vent cap.

10. A combination as defined in claim 8, wherein said back wall includes at least one air hole formed therethrough.

11. A combination as defined in claim 8, wherein said front wall has said valve opening formed therein.

12. In combination:

a container having a product dispensing valve; and a harness for suspending said container in an orientation that permits dispensing of a product from said container, said harness comprising a sling for holding said container therein and at least one strap for suspending said sling from above, wherein said sling includes a valve opening for allowing said product dispensing valve of said container to protrude out of said sling, and wherein said sling comprises a sling body having a bottom, a front wall extending upwardly from said bottom, a back wall and two side walls extending upwardly from said bottom, said front wall, said back wall and said side walls forming a bag for supporting the container therein, and wherein the harness comprises two front strap portions and two rear strap portions each respectively attached at one end to said sling body, said front strap portions being disposed at an angle with respect to said rear strap portions to facilitate suspending said sling body from a wall.

* * * * *